US010851431B2

(12) United States Patent
Han et al.

(10) Patent No.: US 10,851,431 B2
(45) Date of Patent: Dec. 1, 2020

(54) GRAIN-ORIENTED ELECTRICAL STEEL SHEET AND MANUFACTURING METHOD THEREFOR

(71) Applicant: POSCO, Pohang-si (KR)

(72) Inventors: Kyu-Seok Han, Pohang-si (KR); Hyung Don Joo, Pohang-si (KR); Jong-Tae Park, Pohang-si (KR); Jin-Wook Seo, Pohang-si (KR); Hyun-Seok Ko, Pohang-si (KR)

(73) Assignee: POSCO, Pohang-si (KR)

( * ) Notice: Subject to any disclaimer, the term of this patent is extended or adjusted under 35 U.S.C. 154(b) by 280 days.

(21) Appl. No.: 15/537,749

(22) PCT Filed: Dec. 18, 2015

(86) PCT No.: PCT/KR2015/013924

§ 371 (c)(1),
(2) Date: Jun. 19, 2017

(87) PCT Pub. No.: WO2016/099191

PCT Pub. Date: Jun. 23, 2016

(65) Prior Publication Data

US 2018/0002772 A1 Jan. 4, 2018

(30) Foreign Application Priority Data

Dec. 18, 2014 (KR) ..... 10-2014-0183616

(51) Int. Cl.

| | |
|---|---|
| ***C21D 8/12*** | (2006.01) |
| ***C22C 38/12*** | (2006.01) |
| ***C22C 38/02*** | (2006.01) |
| ***C22C 38/20*** | (2006.01) |
| ***C22C 38/08*** | (2006.01) |
| ***C22C 38/18*** | (2006.01) |
| ***C22C 38/00*** | (2006.01) |
| ***C22C 38/24*** | (2006.01) |
| ***C22C 38/26*** | (2006.01) |
| ***C22C 38/04*** | (2006.01) |
| ***H01F 1/16*** | (2006.01) |
| ***C22C 38/06*** | (2006.01) |
| ***C22C 38/34*** | (2006.01) |
| ***C22C 38/22*** | (2006.01) |
| ***C22C 38/28*** | (2006.01) |
| ***C22C 38/32*** | (2006.01) |
| ***C21D 9/46*** | (2006.01) |
| ***C22C 38/14*** | (2006.01) |
| *H01F 1/147* | (2006.01) |
| *C21D 9/52* | (2006.01) |

(52) U.S. Cl.

CPC ..... *C21D 8/1255* (2013.01); *C21D 8/1244* (2013.01); *C21D 9/46* (2013.01); *C22C 38/00* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *H01F 1/16* (2013.01); *C21D 8/1222* (2013.01); *C21D 8/1233* (2013.01); *C21D 9/52* (2013.01); *C21D 2201/05* (2013.01); *H01F 1/147* (2013.01); *H01F 1/14775* (2013.01)

(58) Field of Classification Search

CPC ..... C21D 2201/05; C21D 8/1222; C21D 8/1233; C21D 8/1244; C21D 8/1255; C21D 9/46; C21D 9/52; C22C 38/00; C22C 38/001; C22C 38/02; C22C 38/04; C22C 38/06; C22C 38/08; C22C 38/12; C22C 38/14; C22C 38/18; C22C 38/20; C22C 38/22; C22C 38/24; C22C 38/26; C22C 38/28; C22C 38/32; C22C 38/34; H01F 1/147; H01F 1/14775; H01F 1/16

See application file for complete search history.

(56) References Cited

FOREIGN PATENT DOCUMENTS

| | | |
|---|---|---|
| CN | 1249008 A | 3/2000 |
| CN | 1481444 A | 3/2004 |

(Continued)

OTHER PUBLICATIONS

International Search Report dated Mar. 29, 2016, issued in International Application No. PCT/KR2015/013924. (w/ partial English translation).

(Continued)

*Primary Examiner* — Jenny R Wu

(74) *Attorney, Agent, or Firm* — Morgan, Lewis & Bockius LLP

(57) ABSTRACT

A method for manufacturing a grain-oriented electrical steel sheet, according to an embodiment of the present invention includes: heating a slab, based on 100 wt % of a total composition thereof, including N at 0.0005 wt % to 0.015 wt %, Ti at 0.0001 wt % to 0.020 wt %, V at 0.0001 wt % to 0.020 wt %, Nb at 0.0001 wt % to 0.020 wt %, B at 0.0001 wt % to 0.020 wt %, and the remaining portion including Fe and other impurities, and then hot rolling it to prepare a hot-rolled steel sheet; annealing the hot-rolled steel sheet; after the hot-rolled steel sheet is annealed, cooling the hot-rolled steel sheet, and then cold rolling it to prepare a cold-rolled steel sheet; decarburization-annealing the cold-rolled steel sheet and then nitriding-annealing it, or simultaneously performing the decarburization-annealing and the nitriding-annealing; and final-annealing the decarburization-annealed and nitriding-annealed steel sheet.

5 Claims, No Drawings

(56) References Cited

FOREIGN PATENT DOCUMENTS

| | | | | | |
|---|---|---|---|---|---|
| CN | 101952462 | A | | 1/2011 | |
| CN | 101992210 | A | | 3/2011 | |
| CN | 103687966 | A | | 3/2014 | |
| CN | 107002161 | A | | 8/2017 | |
| EP | 1227163 | A2 | | 7/2002 | |
| EP | 2540844 | A1 | | 1/2013 | |
| JP | 01-230721 | A | | 9/1989 | |
| JP | 01-283324 | A | | 11/1989 | |
| JP | H09194941 | A | | 7/1997 | |
| JP | H10-140297 | A | | 5/1998 | |
| JP | H10121213 | A | | 5/1998 | |
| JP | H10140297 | A | * | 5/1998 | |
| JP | 2000-129356 | A | | 5/2000 | |
| JP | 2003-034821 | A | | 2/2003 | |
| JP | 2003-226916 | A | | 8/2003 | |
| JP | 2005-133175 | A | | 5/2005 | |
| JP | 2008-001983 | A | | 1/2008 | |
| JP | 2008-063655 | A | | 3/2008 | |
| JP | 2008063655 | A | * | 3/2008 | |
| JP | 4075083 | B2 | | 4/2008 | |
| JP | 2009-256713 | A | | 11/2009 | |
| JP | 2011-052302 | A | | 3/2011 | |
| JP | 2011-162874 | A | | 8/2011 | |
| JP | 2011219793 | A | | 11/2011 | |
| JP | 2013-512332 | A | | 4/2013 | |
| KR | 10-1322505 | B1 | | 10/2013 | |
| KR | 10-2014-0070684 | A | | 6/2014 | |
| WO | 2008078915 | A1 | | 7/2008 | |
| WO | 2009/091127 | A2 | | 7/2009 | |
| WO | WO-2009091127 | A2 | * | 7/2009 | ..... C21D 8/1255 |
| WO | 2010116936 | A1 | | 10/2010 | |
| WO | 2011/063934 | A1 | | 6/2011 | |
| WO | WO-2012168253 | A1 | * | 12/2012 | ..... C21D 8/1255 |

OTHER PUBLICATIONS

Extended European Search Report issued in corresponding European Patent Application No. 15870358.7, dated Oct. 6, 2017.

Chinese Office Action dated Jul. 30, 2019 issued in Chinese Patent Application No. 201580069644.9.

"General precipitation of nanophase and influencing factors," Common Knowledge Evidence, Sep. 30, 2008, pp. 165-167 (English translation).

* cited by examiner

GRAIN-ORIENTED ELECTRICAL STEEL SHEET AND MANUFACTURING METHOD THEREFOR

CROSS-REFERENCE TO RELATED APPLICATIONS

This application is the U.S. National Phase of PCT/KR2015/013924 filed Dec. 18, 2015, which claims priority to Korean Patent Application No. 10-2014-0183616 filed Dec. 18, 2014. The subject matter of each is incorporated herein by reference in entirety.

TECHNICAL FIELD

The present invention relates to a grain-oriented electrical steel sheet and a manufacturing method therefor.

BACKGROUND ART

Generally, in an grain-oriented electrical steel sheet having an excellent magnetic characteristic, a Goss texture of a {110}<001> orientation should strongly develop in a rolling direction thereof, and in order to form such a Goss texture, abnormal grain growth corresponding to secondary recrystallization must be formed. The abnormal grain growth occurs when normally growing grain boundaries are inhibited by precipitates, inclusions, or elements that are solid-dissolved or segregated, unlike the normal grain growth. The precipitates, the inclusions, and the like that inhibit the grain growth is specifically called a grain growth inhibitor, and research for manufacturing the grain-oriented electrical steel sheet by the secondary recrystallization of the {110}<001> orientation have focused on securing excellent magnetic properties by forming secondary recrystallization with high integration in the {110}<001> orientation by using a strong inhibitor. Ti, B, Nb, V, etc. are inevitably contained in an ironmaking process and a steelmaking process, but these components have difficulties in controlling formation of precipitates, which makes it difficult to use them as inhibitors. Accordingly, they have been managed to be contained as little as possible in the steelmaking process. As a result, the steelmaking process becomes complicated and a process load thereof increases.

DISCLOSURE

Technical Problem

The present invention has been made in an effort to provide a manufacturing method of a grain-oriented electrical steel sheet. In addition, the present invention has been made in an effort to provide a grain-oriented electrical steel sheet.

Technical Solution

An exemplary embodiment of the present invention provides a manufacturing method of a grain-oriented electrical steel sheet, including: heating a slab, based on 100 wt % of a total composition thereof, including N at 0.0005 wt % to 0.015 wt %, Ti at 0.0001 wt % to 0.020 wt %, V at 0.0001 wt % to 0.020 wt %, Nb at 0.0001 wt % to 0.020 wt %, B at 0.0001 wt % to 0.020 wt %, and the remaining portion including Fe and other impurities, and then hot rolling it to prepare a hot-rolled steel sheet; annealing the hot-rolled steel sheet; after the hot-rolled steel sheet is annealed, cooling the hot-rolled steel sheet, and then cold rolling it to prepare a cold-rolled steel sheet; decarburization-annealing the cold-rolled steel sheet and then nitriding-annealing it, or simultaneously performing the decarburization-annealing and the nitriding-annealing; and final-annealing the decarburization-annealed and nitriding-annealed steel sheet.

The annealing of the hot-rolled steel sheet may include heating the steel sheet, primary-soaking the heated steel sheet, cooling the primary-soaked steel sheet and then secondary-soaking it, and cooling the secondary-soaked steel sheet, and the heating may progress to a primary soaking temperature at 15° C./s or more.

The primary soaking may be performed at a soaking temperature of 1000° C. to 1150° C.

The primary soaking may be performed for 5 s or more.

The secondary soaking may be performed at a soaking temperature of 700° C. to 1050° C., and a difference between the primary soaking temperature and the secondary soaking temperature may be 20° C. or more.

When the primary soaked steel sheet is cooled, a cooling rate thereof may be 10° C./s or more.

The secondary soaked steel sheet may be cooled to 200° C. or less, and a cooling rate thereof may be 20° C./s or more.

The secondary soaking may be performed for 1 s or more.

In the hot rolling for preparing the hot-rolled steel sheet, a hot rolling finish temperature may be 850° C. or more.

The manufacturing method of the grain-oriented electrical steel sheet may further include winding the hot-rolled steel sheet after the hot-rolled steel sheet is prepared, wherein a hot-rolled steel sheet winding temperature is 600° C. or less.

A reduction ratio during the cold rolling may be 80% or more (wherein the reduction ratio corresponds to "(thickness of steel sheet before rolling−thickness of steel sheet after rolling)/(thickness of steel sheet before rolling)).

The steel sheet may be cold-rolled to a final thickness thereof by one pass rolling, or the steel sheet may be cold-rolled to a final thickness thereof by rolling of two passes or more including intermediate annealing, and at least one pass rolling may be performed at 150° C. to 300° C.

The slab, based on 100 wt % of a total composition thereof, may include C at 0.01 wt % to 0.1 wt %, Si at 2.0 wt % to 4.0 wt %, Mn at 0.01 wt % to 0.30 wt %, Al at 0.005 wt % to 0.040 wt %, Sn at 0.005 wt % to 0.20 wt %, S at 0.0005 wt % to 0.020 wt %, Se at 0.0005 wt % to 0.020 wt %, and P at 0.005 wt % to 0.1 wt %.

A total amount of Ti, V, Nb, and B included in the slab, based on 100 wt % of the total composition of the slab, may be 0.0001 wt % to 0.043 wt %.

The slab, based on 100 wt % of a total composition thereof, may include Cr at 0.001 wt % to 0.20 wt %, Ni at 0.001 wt % to 0.20 wt %, Cu at 0.001 wt % to 0.90 wt %, Mo at 0.002 wt % to 0.1 wt %, Sb at 0.005 wt % to 0.20 wt %, Bi at 0.0005 wt % to 0.1 wt %, Pb at 0.0001 wt % to 0.02 wt %, As at 0.0001 wt % to 0.02 wt %, or a combination thereof.

Another embodiment of the present invention provides a grain-oriented electrical steel sheet including, based on 100 wt % of a total composition thereof, N at 0.0005 wt % to 0.015 wt %, Ti at 0.0001 wt % to 0.020 wt %, V at 0.0001 wt % to 0.020 wt %, Nb at 0.0001 wt % to 0.020 wt %, B at 0.0001 wt % to 0.020 wt %, and the remaining portion including Fe and other impurities. A total amount of Ti, V, Nb, and B may be 0.0001 wt % to 0.043 wt %. Specifically, the total amount of Ti, V, Nb, and B may be 0.0001 wt % to 0.040 wt %.

In the grain-oriented electrical steel sheet, based on 100 wt % of the total composition thereof, a content of Ti present as a Ti nitride may be 0.0001 wt % or more, a content of V present as a V nitride may be 0.0001 wt % or more, a content of Nb present as a Nb nitride may be 0.0001 wt % or more, and a content of B present as a B nitride may be 0.0001 wt % or more.

Ti, V, Nb, B, or a nitride corresponding to a combination thereof may be segregated at grain boundaries of the grain-oriented electrical steel sheet.

The grain-oriented electrical steel sheet, based on 100 wt % of the total composition thereof, may include C at 0.01 wt % to 0.1 wt %, Si at 2.0 wt % to 4.0 wt %, Mn at 0.01 wt % to 0.30 wt %, Al at 0.005 wt % to 0.040 wt %, Sn at 0.005 wt % to 0.20 wt %, S at 0.0005 wt % to 0.020 wt %, Se at 0.0005 wt % to 0.020 wt %, and P at 0.005 wt % to 0.1 wt %.

The grain-oriented electrical steel sheet, based on 100 wt % of the total composition thereof, may include Cr at 0.001 wt % to 0.20 wt %, Ni at 0.001 wt % to 0.20 wt %, Cu at 0.001 wt % to 0.90 wt %, Mo at 0.002 wt % to 0.1 wt %, Sb at 0.005 wt % to 0.20 wt %, Bi at 0.0005 wt % to 0.1 wt %, Pb at 0.0001 wt % to 0.02 wt %, As at 0.0001 wt % to 0.02%, or a combination thereof.

Advantageous Effects

According to the embodiment of the present invention, it is possible to use Ti, B, V, Nb, or a combination thereof as an inhibitor in a grain-oriented electrical steel sheet manufacturing process by minutely precipitating them.

In addition, according to the embodiment of the present invention, it is possible to provide a grain-oriented electrical steel sheet with excellent magnetic properties and small iron loss.

MODE FOR INVENTION

The advantages and features of the present invention and the methods for accomplishing the same will be apparent from the exemplary embodiments described hereinafter with reference to the accompanying drawings. However, the present invention is not limited to the exemplary embodiments described hereinafter, but may be embodied in many different forms. The following exemplary embodiments are provided to make the disclosure of the present invention complete and to allow those skilled in the art to clearly understand the scope of the present invention, and the present invention is defined only by the scope of the appended claims. Throughout the specification, the same reference numerals denote the same constituent elements.

In some exemplary embodiments, detailed description of well-known technologies will be omitted to prevent the disclosure of the present invention from being interpreted ambiguously. Unless otherwise defined, all terms (including technical and scientific terms) used herein have the same meaning as commonly understood by one of ordinary skill in the art. In addition, throughout the specification, unless explicitly described to the contrary, the word "comprise" and variations such as "comprises" or "comprising" will be understood to imply the inclusion of stated elements but not the exclusion of any other elements. Further, as used herein, the singular forms "a", "an", and "the" are intended to include the plural forms as well, unless the context clearly indicates otherwise.

Further, as used herein, % means wt %, and 1 ppm corresponds to 0.0001 wt %, unless the context clearly indicates otherwise.

Hereinafter, a manufacturing method of a grain-oriented electrical steel sheet according to an exemplary embodiment of the present invention will be described.

First, a slab, based on 100 wt % of a total composition thereof, including N at 0.0005 wt % to 0.015 wt %, Ti at 0.0001 wt % to 0.020 wt %, V at 0.0001 wt % to 0.020 wt %, Nb at 0.0001 wt % to 0.020 wt %, B at 0.0001 wt % to 0.020 wt %, and the remaining portion including Fe and other impurities, is prepared.

A total amount of the Ti, V, Nb, and B included in the slab may be in a range of 0.0001 wt % to 0.040 wt %.

The slab may include C at 0.01 wt % to 0.1 wt %, Si at 2.0 wt % to 4.0 wt %, Mn at 0.01 wt % to 0.30 wt %, Al at 0.005 wt % to 0.040 wt %, Sn at 0.005 wt % to 0.20 wt %, S at 0.0005 wt % to 0.020 wt %, Se at 0.0005 wt % to 0.020 wt %, and P at 0.005 wt % to 0.1 wt %.

The slab may include Cr at 0.001 wt % to 0.20 wt %, Ni at 0.001 wt % to 0.20 wt %, Cu at 0.001 wt % to 0.90 wt %, Mo at 0.002 wt % to 0.1 wt %, Sb at 0.005 wt % to 0.20 wt %, Bi at 0.0005 wt % to 0.1 wt %, Pb at 0.0001 wt % to 0.02 wt %, As at 0.0001 wt % to 0.02 wt %, or a combination thereof.

First, a reason for limiting the components will be described.

N is an element that serves as an inhibitor by forming a nitride. When a N content is more than 0.015%, a surface defect due to nitrogen diffusion may occur in a process after a hot rolling process, and when the N content is less than 0.0005%, formation of the nitride is small and a size of a grain becomes coarse, thus it is difficult to control a size of a primary recrystallized grain and unstable secondary recrystallization may be caused.

Ti is an element that serves as an inhibitor by forming a nitride in one embodiment of the present invention. When a Ti content is less than 0.0001%, its effect of inhibiting the grain growth as an inhibitor deteriorates, and when the Ti content is more than 0.02%, since its effect of inhibiting the grain growth is strong, secondary recrystallization does not occur, and even after a purification annealing process, a large amount of TiN is present to decrease magnetism.

V is an element that serves as an inhibitor by forming a nitride in one embodiment of the present invention. When a V content is less than 0.0001%, its effect of inhibiting the grain growth as an inhibitor deteriorates, and when the V content is more than 0.02%, a carbide is formed, thus magnetism may deteriorate.

Nb is an element that serves as an inhibitor by forming a nitride in one embodiment of the present invention. When a Nb content is less than 0.0001%, its effect of inhibiting the grain growth as an inhibitor decreases, and when the Nb content is more than 0.02%, a carbide is formed, thus magnetism may deteriorate.

B is an element that serves as an inhibitor by forming a nitride in one embodiment of the present invention. When a B content is less than 0.0001%, its effect of inhibiting the grain growth as an inhibitor decreases, and when the B content is more than 0.02%, a carbide is formed, thus magnetism may deteriorate.

When C is added at 0.01% or more, it accelerates phase transformation of austenite, causes a hot-rolled structure of the grain-oriented electrical steel sheet to be uniform, and promotes formation of a grain with a Goss orientation during a cold rolling process. When C exceeds 0.10%, a fine hot-rolled structure is formed, primary recrystallized grains become minute to be able to form coarse carbide, and cementite may be formed to cause unevenness of the structure.

Si serves to lower core loss thereof by increasing specific resistance of the electrical steel sheet. When a Si content is less than 2.0%, since the specific resistance is reduced, iron loss characteristic may deteriorate, and when the Si content is more than 4.0%, since brittleness of the steel sheet increases, a cold rolling process may become extremely difficult.

Mn may reduce iron loss by increasing specific resistance, and forms MnS precipitates by reacting with S, thus it may be used as an inhibitor for inhibiting the growth of the primary recrystallized grains. When a Mn content is less than 0.01%, it is difficult to inhibit a cracking phenomenon during the hot rolling process, and the specific resistance may slightly increase. When the Mn content is more than 0.3%, Mn oxide may be formed to lower surface quality.

Al may serve as an inhibitor by forming AlN. When an Al content is less than 0.005%, its inhibitory force as an inhibitor may become insufficient, and when the Al content is more than 0.04%, since precipitates coarsely grow, it may not serve as the inhibitor.

Sn inhibits movement of grain boundaries and promotes formation of grains of a Goss orientation. When a Sn content is less than 0.005%, it is difficult to obtain the effect of inhibiting the movement of the grain boundaries, and when it is more than 0.2%, the brittleness of the steel sheet may be increased.

S serves as an inhibitor by forming a sulfide. S may serve as an auxiliary inhibitor in another embodiment of the present invention. When a S content is less than 0.0005%, it is difficult to form MnS, and when it is more than 0.02%, secondary recrystallization becomes difficult, and a high temperature cracking phenomenon may be caused during the hot rolling process.

Se may serve as an inhibitor by reacting with Mn to form MnSe precipitates. When a Se content is less than 0.0005%, it is difficult to form MnSe, and when it is more than 0.02%, secondary recrystallization becomes difficult, and a high temperature cracking phenomenon may be caused during the hot rolling process.

P may serve as an inhibitor, and improve {110}<001> texture in terms of texture. When a P content is less than 0.005%, P may serve as an inhibitor, and when the P content is more than 0.1%, the brittleness may increase such that the rolling property deteriorates.

When a total amount of Ti, V, Nb, and B is less than 0.001%, the effect of inhibiting the grain growth as an inhibitor deteriorates, and when the total amount of Ti, V, Nb, and B is more than 0.043%, the carbonitride may be coarsened to deteriorate magnetism.

In addition, in the embodiment of the present invention, the slab may further include Cr at 0.001 wt % to 0.20 wt %, Ni at 0.001 wt % to 0.20 wt %, Cu at 0.001 wt % to 0.90 wt %, Mo at 0.002% to 0.1 wt %, Sb at 0.005 wt % to 0.20 wt %, Bi at 0.0005 wt % to 0.1 wt %, Pb at 0.0001 wt % to 0.02%, As at 0.0001 wt % to 0.02%, or a combination thereof, thus it is possible to increase Goss orientation grains and to stabilize the surface quality.

The slab is heated and then hot rolled to manufacture a hot-rolled steel sheet.

The slab may be heated at 1050° C. to 1250° C.

In addition, in the embodiment of the present invention, a hot rolling finish temperature may be 850° C. or more in order to use Ti, V, Nb, B, or a nitride corresponding to a combination thereof as an inhibitor. Specifically, the hot rolling finish temperature may be in a range of 850 to 930° C. When the hot rolling finish temperature is less than 850° C., a hot rolling load is increased, and Ti, V, Nb, and B react with carbon and nitrogen in the steel to form coarse carbides or nitrides, thus the inhibitor effect may deteriorate.

Further, in the embodiment of the present invention, in order to use Ti, V, Nb, B, or a nitride corresponding to a combination thereof as an inhibitor, after preparing the hot rolling sheet, when the hot rolling sheet is spiral-wound, a temperature of spiral-winding process may be 600° C. or less. Specifically, the temperature of spiral-winding process may be in a range of 530 to 600° C. When the temperature of spiral-winding process is more than 600° C., Ti, V, Nb, and B form a coarse carbide, so that the inhibitor effect may be deteriorated.

The prepared hot rolling sheet is annealed.

In the embodiment of the present invention, in order to use Ti, V, Nb, B, or a nitride corresponding to a combination thereof as an inhibitor, the following hot-rolled steel sheet annealing method may be provided.

In the embodiment of the present invention, a hot-rolled steel sheet annealing step includes a step for heating a steel sheet, a step for primarily soaking the steel sheet after the heating is completed, and a step for cooling and then secondarily soaking the steel plate after the primary soaking is completed.

The heating may be progressed from below the hot-rolled steel sheet winding temperature to the primary soaking temperature at a heating rate of 15° C./s or more. Specifically, the heating rate may be in a range of 30 to 50° C./s. When the heating rate is less than 15° C./s, a carbide or nitride may be formed during the heating.

The primary soaking temperature may be in a range of 1000° C. to 1150° C. When the primary soaking temperature is less than 1000° C., the carbide or nitride is not re-solid-dissolved but is easily precipitated and grown, thus the secondary recrystallization may be difficult. When the primary soaking temperature is more than 1150° C., the growth of the recrystallized grains of the hot-rolled steel sheet may be coarsened, thus it is difficult to form an appropriate primary recrystallized microstructure.

A soak holding time in the primary soaking may be 5 s or more. When the soak holding time is less than 5 s, since a time for which the carbide and nitride are re-solid-dissolved is insufficient, it may be difficult to secure a required precipitate structure.

The temperature of the secondary soaking may be in a range of 700° C. to 1050° C. When the temperature of the secondary soaking is less than 700° C., a carbide may be formed together in addition to the nitride, thus it may be difficult to form a uniform primary recrystallized microstructure. When the temperature of the secondary soaking is more than 1050° C., Ti, V, Nb, and B are not precipitated but are present in a solid solution state to form the carbide during the cold rolling, thus it may be difficult to secure the uniform primary recrystallized microstructure.

A soak holding time in the secondary soaking may be 1 s or more. When the soak holding time is less than 1 s, Ti, V, Nb, B, or a nitride corresponding to a combination thereof may be difficult to be precipitated.

A difference between the primary soaking temperature and the secondary soaking temperature may be 20° C. or more.

Precipitation driving force is required for minute and uniform precipitation of precipitate-forming elements such as TiN, VN, NbN, and BN solid-dissolved by the heating and the primary soaking, and the precipitation driving force corresponds to the difference between the primary soaking temperature and the secondary soaking temperature. When the difference between the primary soaking temperature and the secondary soaking temperature is less than 20° C., since the precipitation driving force is insufficient, TiN, VN, NbN, and BN may be difficult to be precipitated. Accordingly, in the cold rolling process, Ti, V, Nb, and B may form a carbide.

In addition, when cooling the primary soaked steel sheet, a cooling rate may be 10° C./s or more. Specifically, the cooling rate may be in a range of 25 to 100° C./s. When the cooling rate is less than 10° C./s, the precipitation driving force decreases, thus TiN, VN, NbN, and BN may be difficult to be precipitated.

Further, when cooling the secondary soaked steel sheet, it may be cooled to a temperature of 200° C. or less at a cooling rate of 20° C./s or more. Specifically, the cooling rate may be in a range of 25 to 200° C./s. When the cooling rate is less than 20° C./s, nitrides of Ti, V, Nb, and B are coarsely precipitated during the cooling process, thus a final magnetic property may deteriorate.

The steel sheet after the hot-rolled steel sheet annealing is completed is cold-rolled to manufacture a cold rolled steel sheet.

The steel sheet may be cold-rolled to a final thickness by one pass rolling or cold-rolled to a final thickness by rolling of two passes or more. When the steel sheet is cold-rolled to the final thickness by the rolling of two passes or more, at least one intermediate annealing may be performed between respective passes.

During the cold rolling, at least one pass rolling may be performed at 150° C. to 300° C. When the cold rolling is performed at 150° C. or more, because of work hardening (strain hardening) by solid solution carbon, generation of secondary recrystallization nuclei of the Goss orientation is improved to increase magnetic flux density. However, when the cold rolling is performed at more than 300° C., since the work hardening by the solid solution carbon is weakened, the generation of the secondary recrystallization nuclei of the Goss orientation may be insufficient.

In the cold rolling, a reduction ratio may be 80 wt % or more. Herein, the reduction ratio is defined as "(thickness of steel sheet before rolling−thickness of steel sheet after rolling)/(thickness of steel sheet before rolling)". When the reduction ratio is less than 80 wt %, the density of the Goss orientation may be reduced to decrease magnetic flux density.

The completely cold rolled steel sheet is decarburization-annealed, and then nitriding-annealed. Alternatively, the decarburization-annealing and the nitriding-annealing may be simultaneously performed. While the decarburization-annealing is performed, a temperature may be raised to 700° C. or higher at a rate of 20° C./s or more. When the rate is less than 20° C./s, the generation of the primary recrystallization grains of the Goss orientation is insufficient to deteriorate the magnetic flux density.

The nitriding-annealing is performed by $NH_3$ gas, and AlN, (Al,Si)N, (Al,Si,Mn)N, or a complex nitride containing Ti, V, Nb, or B may be formed.

When the decarburization-annealing and the nitriding-annealing are completed, final annealing is performed.

While the final annealing is performed, the temperature is increased to 1000° C. or more, and then soaking-annealing is performed for a long time to cause secondary recrystallization, thus a texture of {110}<001> Goss orientation is formed, and at this time, Ti, V, Nb, B, or a nitride corresponding to a combination thereof serves as an inhibitor.

In addition, during the final annealing, nitrogen and hydrogen are maintained as a mixed gas in the temperature increased period to protect the nitride corresponding to a grain growth inhibitor so that the secondary recrystallization may be formed well, and after the secondary recrystallization is completed, the impurities may be removed by being maintained in the hydrogen atmosphere for a long time.

Hereinafter, a grain-oriented electrical steel sheet according to an embodiment of the present invention will be described.

A grain-oriented electrical steel sheet according to an embodiment of the present invention includes N at 0.0005 wt % to 0.015 wt %, Ti at 0.0001 wt % to 0.020 wt %, V at 0.0001 wt % to 0.020 wt %, Nb at 0.0001 wt % to 0.020 wt %, B at 0.0001 wt % to 0.020 wt %, and the remaining portion including Fe and other impurities. A total amount of Ti, V, Nb, and B may be in a range of 0.0001 wt % to 0.040 wt %.

In the grain-oriented electrical steel sheet, a content of Ti present as a Ti nitride may be 0.0001 wt % or more, a content of V present as a V nitride may be 0.0001 wt % or more, a content of Nb present as a Nb nitride may be 0.0001 wt % or more, and a content of B present as a B nitride may be 0.0001 wt % or more. Ti, V, Nb, B, or a nitride corresponding to a combination thereof may be segregated at grain boundaries. This is because Ti, V, Nb, B, or a nitride corresponding to a combination thereof serves as an inhibitor in the secondary recrystallization annealing process in the embodiment of the present invention.

In addition, the grain-oriented electrical steel sheet may further include C at 0.01 wt % to 0.1 wt %, Si at 2.0 wt % to 4.0 wt %, Mn at 0.01 wt % to 0.30 wt %, Al at 0.005 wt % to 0.040 wt %, Sn at 0.005 wt % to 0.20 wt %, S at 0.0005 wt % to 0.020 wt %, Se at 0.0005 wt % to 0.020 wt %, and P at 0.005 wt % to 0.1 wt %.

Further, the grain-oriented electrical steel sheet may further include Cr at 0.001 wt % to 0.20 wt %, Ni at 0.001 wt % to 0.20 wt %, Cu at 0.001 wt % to 0.90 wt %, Mo at 0.002% to 0.1 wt %, Sb at 0.005 wt % to 0.20 wt %, Bi at 0.0005 wt % to 0.1 wt %, Pb at 0.0001 wt % to 0.02%, As at 0.0001 wt % to 0.02%, or a combination thereof.

The reason for limiting the components of the grain-oriented electrical steel sheet has been described in the reason for limiting the components of the slab, so the detailed description thereof will be omitted.

Hereinafter, examples will be described in detail. However, the following examples are illustrative of the present invention, so the present invention is not limited thereto.

EXAMPLE 1

A slab, which included C at 0.055 wt %, Si at 3.3 wt %, Mn at 0.12 wt %, Al at 0.024 wt %, S at 0.0050 wt %, Se at 0.0030 wt %, N at 0.0050 wt %, P at 0.03 wt %, and Sn at 0.06 wt %, includes Ti, V, Nb, and B as in Table 1, and included the remaining portion including Fe and other inevitably added impurities, was heated to 1150° C. and then hot rolled.

The hot rolling was finished at 900° C. to prepare the hot-rolled steel sheet having a final thickness of 2.3 mm, and the hot-rolled steel sheet was cooled and then spiral-wound at 550° C.

Next, the hot-rolled steel sheet was heated to a primary soaking temperature of 1080° C. at a heating rate of 25° C./s and maintained for 30 s, was then cooled to a secondary soaking temperature of 900° C. at a cooling rate of 15° C./s and maintained for 120 s, and was then cooled to room temperature at a cooling rate of 20° C./s.

After acid-pickling the steel sheet, it was cold-rolled once to a thickness of 0.23 mm, and the temperature of the steel sheet during the cold rolling was set to be 220° C. Subsequently, the cold-rolled steel sheet was maintained at a temperature of 865° C. for 155 s in a mixed gas atmosphere of hydrogen, nitrogen, and ammonia to simultaneously perform decarburization and nitriding so that a total nitrogen content of the steel sheet became 0.0200 wt %.

The steel sheet was then coated with MgO as an annealing separator and subjected to secondary recrystallization high-temperature annealing in a coiled state. In the high-temperature annealing, while being heated to 1200° C., it was in a mixed gas atmosphere of 25 vol % $N_2$ and 75 vol % $H_2$, and after reaching 1200° C., it was maintained in a 100 vol % $H_2$ atmosphere for 10 h and then slowly cooled. Table 1 shows measured values of magnetic properties ($W_{17/50}$, $B_8$) after the secondary recrystallization high-temperature annealing with respect to each alloy component.

TABLE 1

| Ti (wt %) | V (wt %) | Nb (wt %) | B (wt %) | Magnetic flux density ($B_8$,Tesla) | Iron loss ($W_{17/50}$, W/kg) | Classification |
|---|---|---|---|---|---|---|
| 0.00005 | 0.00005 | 0.00005 | 0.00005 | 1.877 | 0.998 | Comparative material 1 |
| 0.0005 | 0.0010 | 0.0005 | 0.0005 | 1.913 | 0.813 | Inventive material 1 |
| 0.0012 | 0.0034 | 0.0029 | 0.0015 | 1.909 | 0.830 | Inventive material 2 |
| 0.0034 | 0.0086 | 0.0077 | 0.0023 | 1.925 | 0.805 | Inventive material 3 |
| 0.0020 | 0.0098 | 0.0069 | 0.0052 | 1.918 | 0.816 | Inventive material 4 |
| 0.0023 | 0.0040 | 0.0043 | 0.0103 | 1.932 | 0.799 | Inventive material 5 |
| 0.0018 | 0.0027 | 0.0200 | 0.0178 | 1.936 | 0.806 | Inventive material 6 |
| 0.0024 | 0.0076 | 0.0062 | 0.0215 | 1.832 | 1.032 | Comparative material 2 |
| 0.0053 | 0.0045 | 0.0075 | 0.0032 | 1.948 | 0.765 | Inventive material 7 |
| 0.0080 | 0.0051 | 0.0035 | 0.0035 | 1.940 | 0.789 | Inventive material 8 |
| 0.0144 | 0.0076 | 0.0082 | 0.0015 | 1.947 | 0.772 | Inventive material 9 |
| 0.0203 | 0.0041 | 0.0075 | 0.0025 | 1.881 | 0.978 | Comparative material 3 |
| 0.0023 | 0.0141 | 0.0078 | 0.0022 | 1.935 | 0.798 | Inventive material 10 |
| 0.0058 | 0.0272 | 0.0094 | 0.0028 | 1.856 | 0.989 | Comparative material 4 |
| 0.0032 | 0.0078 | 0.0111 | 0.0010 | 1.937 | 0.812 | Inventive material 11 |
| 0.0086 | 0.0022 | 0.0197 | 0.0018 | 1.921 | 0.806 | Inventive material 12 |
| 0.0088 | 0.0058 | 0.0217 | 0.0011 | 1.861 | 0.987 | Comparative material 5 |
| 0.0108 | 0.0102 | 0.0108 | 0.0082 | 1.943 | 0.793 | Inventive material 13 |

As shown in Table 1, it can be seen that the magnetic properties of the electrical steel sheet with the components according to the embodiment of the present invention are excellent.

EXAMPLE 2

A slab, which included C at 0.051 wt %, Si at 3.2 wt %, Mn at 0.09 wt %, Al at 0.026 wt %, S at 0.0040 wt %, Se at 0.0020 wt %, N at 0.006 wt %, P at 0.05 wt %, Sn at 0.05 wt %, Ti at 0.0080 wt %, V at 0.0051 wt %, Nb at 0.0035 wt %, B at 0.0035 wt %, and the remaining portion including Fe and other inevitably added impurities, was heated to 1150° C. and then hot rolled. Next, as shown in Table 2, a hot rolled steel sheet having a thickness of 2.3 mm was prepared by varying a hot rolling finish temperature and a winding temperature. The hot-rolled steel sheet was heated to a primary soaking temperature of 1080° C. at a heating rate of 25° C./s or more and maintained for 30 s, was then cooled to a secondary soaking temperature of 900° C. at a cooling rate of 15° C./s and maintained for 120 s, and was then cooled to room temperature at a cooling rate of 20° C./s.

Next, after acid-pickling the steel sheet, it was cold-rolled to a thickness of 0.23 mm, and the temperature of the steel sheet during the cold rolling was set to be 200° C. The cold-rolled steel sheet was heated at a temperature raising rate of 50° C./s, and was maintained at a temperature of 860° C. for 180 s in a mixed gas atmosphere of hydrogen, nitrogen, and ammonia to simultaneously perform decarburization and nitriding so that a total nitrogen content of the steel sheet became 0.0210 wt %. Next, the steel sheet was coated with an annealing separator and subjected to secondary recrystallization high-temperature annealing in a coiled state. In the high-temperature annealing, it was heated to 1200° C. in a mixed gas atmosphere of 25 vol % $N_2$ and 75 vol % $H_2$, and after reaching 1200° C., it was maintained in a 100 vol % $H_2$ atmosphere for 10 h and then slowly cooled.

TABLE 2

| Hot rolling finishing temperature (° C.) | Winding temperature (° C.) | Magnetic flux density ($B_8$, Tesla) | Iron loss ($W_{17/50}$, W/kg) | Classification |
|---|---|---|---|---|
| 950 | 650 | 1.889 | 0.962 | Comparative material 1 |
| 930 | 590 | 1.932 | 0.817 | Inventive material 1 |

TABLE 2-continued

| Hot rolling finishing temperature (° C.) | Winding temperature (° C.) | Magnetic flux density ($B_8$, Tesla) | Iron loss ($W_{17/50}$, W/kg) | Classification |
|---|---|---|---|---|
| 910 | 580 | 1.929 | 0.826 | Inventive material 2 |
| 900 | 550 | 1.940 | 0.789 | Inventive material 3 |
| 890 | 530 | 1.938 | 0.806 | Inventive material 4 |
| 840 | 530 | 1.896 | 0.926 | Comparative material 2 |
| 890 | 610 | 1.882 | 0.932 | Comparative material 3 |
| 870 | 550 | 1.934 | 0.795 | Inventive material 5 |

As shown in Table 2, when the hot rolling finish temperature was less than 850° C., since formation of nitrides of Al, Ti, V, Nb, and B was promoted such that uniform formation of primary recrystallization was hindered, it was difficult to ensure excellent magnetic properties through stable secondary recrystallization. In addition, when the winding temperature was equal to or greater than 600° C., as possibility of formation of carbonitrides such as Al, Ti, V, Nb, and B increased, secondary recrystallization became unstable, thus it was difficult to secure excellent magnetic properties.

EXAMPLE 3

A slab, which included C at 0.058 wt %, Si at 3.4 wt %, Mn at 0.15 wt %, Al at 0.028 wt %, S at 0.0030 wt %, Se at 0.0050 wt %, N at 0.008 wt %, P at 0.03 wt %, Sn at 0.08 wt %, Ti at 0.0050 wt %, V at 0.0050 wt %, Nb at 0.0150 wt %, B at 0.0035 wt %, and the remaining portion including Fe and other inevitably added impurities, was heated to 1150° C. and then hot rolled. The hot rolling was finished at 880° C. to prepare the hot-rolled steel sheet having a thickness of 2.6 mm, which was then spiral-wound at 530° C.

Next, in the hot-rolled steel sheet annealing, as shown in Table 3, the hot-rolled steel sheet annealing was performed while varying a heating rate, a primary soaking temperature, and a secondary soaking temperature. A cooling rate from the primary soaking temperature to the secondary soaking temperature after primary soaking was completed, and a cooling rate to room temperature after secondary soaking, were each 30° C./s.

Next, the steel sheet was cold-rolled once to a thickness of 0.27 mm, and the temperature of the steel sheet during the cold rolling was set to be 180° C.

Next, after increasing the soaking temperature to 870° C. at a heating rate of 100° C./s from room temperature, it was decarburization-annealed in a mixed gas atmosphere of hydrogen and nitrogen, and was then nitriding-processed in a mixed gas atmosphere of hydrogen, nitrogen, and ammonia such that a total nitrogen content of the steel sheet became 0.0180 wt %. Next, the steel sheet was coated with MgO as an annealing separator and spiral-wound in a coiled form, and was then heated to 1200° C. in a mixed gas atmosphere of 25 vol % $N_2$ and 75 vol % $H_2$, and after reaching 1200° C., it was maintained in a 100 vol % $H_2$ atmosphere for 10 h and then slowly cooled.

TABLE 3

| Heating rate (° C./s) | Primary soaking temperature (° C.) | Secondary soaking temperature (° C.) | Primary and secondary soaking temperature difference (° C.) | Magnetic flux density ($B_8$,Tesla) | Iron loss ($W_{17/50}$, W/kg) | Classification |
|---|---|---|---|---|---|---|
| 20 | 950 | 900 | 50 | 1.815 | 1.162 | Comparative material 1 |
| 10 | 1000 | 950 | 50 | 1.893 | 1.023 | Comparative material 2 |
| 30 | 1050 | 930 | 120 | 1.919 | 0.856 | Inventive material 1 |
| 30 | 1100 | 900 | 200 | 1.924 | 0.842 | Inventive material 2 |
| 30 | 1130 | 920 | 210 | 1.916 | 0.859 | Inventive material 3 |
| 30 | 1170 | 900 | 270 | 1.891 | 1.036 | Comparative material 3 |
| 30 | 1120 | 1060 | 60 | 1.895 | 1.019 | Comparative material 4 |
| 30 | 1080 | 930 | 150 | 1.928 | 0.852 | Inventive material 4 |
| 30 | 1050 | 1035 | 15 | 1.874 | 1.003 | Comparative material 5 |
| 30 | 1080 | 650 | 430 | 1.862 | 1.042 | Comparative material 6 |
| 50 | 1050 | 900 | 150 | 1.945 | 0.841 | Inventive material 5 |

As shown in Table 3, when a heating rate was less than 15° C./s during hot-rolled steel sheet annealing, a tendency in which carbonitrides of Al, Ti, V, Nb, and B were minutely precipitated during the heating was increased, thus the secondary recrystallization became unstable, and when a heating temperature was equal to or more than 1150° C., or less than 1000° C., nitrides of Al, Ti, V, Nb, and B that were minutely precipitated during the hot rolling were not properly solid-dissolved, thus the secondary recrystallization became unstable. When a difference between the heating temperature and the soaking temperature was less than 20° C. and when the soaking temperature was 1050° C. or more, the nitrides of Al, Ti, V, Nb, and B were not re-precipitated but were present in a solid-dissolved state. In this case, since the carbonitrides were formed in the cold rolling process and the decarburization-annealing process, the primary recrystallized microstructure became small, thus the secondary recrystallization allowing excellent magnetic properties to be secured was unstably formed. In addition, when the soaking temperature was less than 700° C., the secondary recrystallization became unstable to deteriorate magnetism as a possibility of carbides being formed increased together with the nitrides of Al, Ti, V, Nb, and B.

EXAMPLE 4

A slab, which included C at 0.048 wt %, Si at 3.2 wt %, Mn at 0.10 wt %, Al at 0.032 wt %, S at 0.0030 wt %, Se at 0.0030 wt %, N at 0.0080 wt %, P at 0.07 wt %, Sn at 0.03 wt %, Ti at 0.0100 wt %, V at 0.0030 wt %, Nb at 0.0050 wt %, B at 0.0025 wt %, and the remaining portion including Fe and other inevitably added impurities, was heated to 1150° C. and then hot rolled.

The hot rolling was finished at 860° C. to prepare the hot-rolled steel sheet having a final thickness of 2.0 mm, and the hot-rolled steel sheet was cooled and spiral-wound at 500° C.

Next, for annealing the hot-rolled steel sheet, the hot-rolled steel sheet was heated to a primary soaking temperature of 1120° C. at a heating rate of 25° C./s and maintained for 60 s, was then cooled to a secondary soaking temperature of 900° C. at a cooling rate (primary cooling rate) shown in Table 4 and maintained for 120 s, and was then cooled to room temperature at a cooling rate (secondary cooling rate) shown in Table 4.

After acid-pickling the steel sheet, it was cold-rolled once to a thickness of 0.30 mm, and the temperature of the steel sheet during the cold rolling was set to be 250° C.

Subsequently, the cold-rolled steel sheet was maintained at a temperature of 875° C. for 200 s in a mixed gas atmosphere of hydrogen, nitrogen, and ammonia to simultaneously perform decarburization and nitriding so that a total nitrogen content of the steel sheet became 0.0250 wt %.

The steel sheet was then coated with MgO as an annealing separator and subjected to secondary recrystallization high-temperature annealing in a coiled state. During the high-temperature annealing, when heated to 1200° C., it was in a mixed gas atmosphere of 25 vol % $N_2$ and 75 vol % $H_2$, and after reaching 1200° C., it was maintained in a 100 vol % $H_2$ atmosphere for 10 h and then slowly cooled.

TABLE 4

| Primary cooling speed (° C./S) | Secondary cooling speed (° C./S) | Magnetic flux density ($B_8$, Tesla) | Iron loss ($W_{17/50}$, W/kg) | Classification |
|---|---|---|---|---|
| 5 | 25 | 1.879 | 1.062 | Comparative material 1 |
| 15 | 10 | 1.942 | 0.941 | Comparative material 2 |
| 25 | 25 | 1.945 | 0.926 | Inventive material 1 |
| 50 | 50 | 1.938 | 0.939 | Inventive material 2 |
| 100 | 150 | 1.952 | 0.906 | Inventive material 3 |
| 100 | 200 | 1.944 | 0.926 | Inventive material 4 |

As shown in Table 4, when the primary cooling rate was less than 10° C./s, a precipitation driving force by which components of Al, Ti, V, Nb, and B solid-dissolved in the heating step during the annealing of the hot-rolled steel sheet were changed into minute nitrides was reduced. Accordingly, when the hot-rolled steel sheet annealing was completed in the solid solution state, minute carbonates of Al, Ti, V, Nb and B were formed in the cold rolling process and the decarburization annealing process, thus the primary recrystallized structure became minute such that the secondary recrystallization became unstable. In addition, when the secondary cooling rate was less than 20° C./s, as the cooling process was gradually progressed from the soaking temperature to room temperature, since a possibility that carbonitrides of Al, Ti, V, Nb, and B would be coarsely formed during the cooling process was increased, the secondary recrystallization was unstably formed, thus a final magnetic property may deteriorate.

While the exemplary embodiments of the present invention have been described hereinbefore, it will be understood by those skilled in the art that various changes in form and details may be made thereto without departing from the technical spirit and essential features of the present invention.

Therefore, the embodiments described above are only examples and should not be construed as being limitative in any respects. The scope of the present invention is determined not by the above description, but by the following claims, and all changes or modifications from the spirit, scope, and equivalents of claims should be construed as being included in the scope of the present invention.

The invention claimed is:

1. A grain-oriented electrical steel sheet comprising, based on 100 wt % of a total composition thereof, N at 0.0005 wt % to 0.015 wt %, Ti at 0.0001 wt % to 0.020 wt %, V at 0.0001 wt % to 0.020 wt %, Nb at 0.0001 wt % to 0.020 wt %, B at 0.0001 wt % to 0.020 wt %, and the remaining portion including Fe and other impurities, wherein a total amount of Ti, V, Nb, and B, based on 100 wt % of the total composition of the grain-oriented electrical steel sheet, is 0.0001 wt % to 0.040 wt % and wherein in the grain-oriented electrical steel sheet, based on 100 wt% of the total composition thereof, a content of Ti present as a Ti nitride is 0.0001 wt% or more, a content of V present as a V nitride is 0.0001 wt% or more, a content of Nb present as a Nb nitride is 0.0001 wt% or more, and a content of B present as a B nitride is 0.0001 wt% or more.

2. The grain-oriented electrical steel sheet of claim 1, wherein

Ti, V, Nb, B, or a nitride corresponding to a combination thereof is segregated at grain boundaries of the grain-oriented electrical steel sheet.

3. The grain-oriented electrical steel sheet of claim 2, wherein the grain-oriented electrical steel sheet, based on 100 wt % of the total composition thereof, includes C at 0.01 wt % to 0.1 wt %, Si at 2.0 wt % to 4.0 wt %, Mn at 0.01 wt % to 0.30 wt %, Al at 0.005 wt % to 0.040 wt %, Sn at 0.005 wt % to 0.20 wt %, S at 0.0005 wt % to 0.020 wt %, Se at 0.0005 wt % to 0.020 wt %, and P at 0.005 wt % to 0.1 wt %.

4. The grain-oriented electrical steel sheet of claim 3, wherein the grain-oriented electrical steel sheet, based on 100 wt % of the total composition thereof, includes Cr at 0.001 wt % to 0.20 wt %, Ni at 0.001 wt % to 0.20 wt %, Cu at 0.001 wt % to 0.90 wt %, Mo at 0.002% to 0.1 wt %, Sb at 0.005 wt % to 0.20 wt %, Bi at 0.0005 wt % to 0.1 wt %, Pb at 0.0001 wt% to 0.02%, As at 0.0001 wt% to 0.02 wt%, or a combination thereof.

5. A manufacturing method of a grain-oriented electrical steel sheet, comprising:

heating a slab, based on 100 wt % of a total composition thereof, including N at 0.0005 wt % to 0.015 wt %, Ti at 0.0001 wt % to 0.020 wt %, V at 0.0001 wt % to 0.020 wt %, Nb at 0.0001 wt % to 0.020 wt %, B at 0.0001 wt % to 0.020 wt %, and the remaining portion including Fe and other impurities, and then hot rolling it to prepare a hot-rolled steel sheet; annealing the hot-rolled steel sheet;

after the hot-rolled steel sheet is annealed, cooling the hot-rolled steel sheet, and then cold rolling it to prepare a cold-rolled steel sheet;

decarburization-annealing the cold-rolled steel sheet and then nitriding-annealing it, or simultaneously performing the decarburization-annealing and the nitriding-annealing; and final-annealing the decarburization-annealed and nitriding-annealed steel sheet, wherein the annealing of the hot-rolled steel sheet includes heating the steel sheet, primary-soaking the heated steel sheet, cooling the primary-soaked steel sheet and then secondary-soaking it, and cooling the secondary-soaked steel sheet, and the heating progresses to a primary soaking temperature at 15° C./s or more;

thereby producing the grain-oriented electrical steel sheet of claim 1.

* * * * *